United States Patent [19]

Ray et al.

[11] 4,351,258

[45] Sep. 28, 1982

[54] METHOD AND APPARATUS FOR TENSION MOORING A FLOATING PLATFORM

[75] Inventors: Donald R. Ray; Riddle E. Steddum, both of Houston, Tex.

[73] Assignee: The Offshore Company, Houston, Tex.

[21] Appl. No.: 138,478

[22] Filed: Apr. 9, 1980

Related U.S. Application Data

[63] Continuation-in-part of Ser. No. 96,075, Nov. 20, 1979, Pat. No. 4,281,613, which is a continuation of Ser. No. 827,145, Aug. 24, 1977, abandoned.

[51] Int. Cl.[3] ..... B63B 21/50

[52] U.S. Cl. ..... 114/230; 114/265; 414/293

[58] Field of Search ..... 114/264, 265, 230, 293; 405/224, 225, 226, 227, 228; 175/7; 166/352, 354

[56] References Cited

U.S. PATENT DOCUMENTS

| | | | |
|---|---|---|---|
| 2,986,888 | 6/1961 | Borrmann et al. | 405/224 |
| 3,355,899 | 12/1967 | Koonce et al. | 114/265 X |
| 3,513,911 | 5/1970 | Petersen | 175/7 X |
| 3,540,396 | 11/1970 | Horton | 114/265 |
| 3,563,042 | 2/1971 | Ryan | 114/265 X |
| 3,577,946 | 5/1971 | Horton | 114/265 |
| 3,603,386 | 9/1971 | Talley, Jr. | 175/7 X |
| 3,605,668 | 9/1971 | Morgan | 114/293 |
| 3,618,661 | 11/1971 | Peterman | 175/7 X |
| 3,626,701 | 12/1971 | Laffont | 405/202 |
| 3,648,638 | 3/1972 | Blenkarn | 114/265 |
| 3,654,886 | 4/1972 | Silverman | 114/265 X |
| 3,745,774 | 7/1973 | Sharp, Jr. | 405/225 |
| 3,955,521 | 5/1976 | Mott | 114/265 |
| 3,979,785 | 9/1976 | Flory | 9/8 P |
| 3,984,991 | 10/1976 | Kagler, Jr. | 175/7 X |
| 4,226,555 | 10/1980 | Bourne, Jr. et al. | 114/264 |

FOREIGN PATENT DOCUMENTS

| | | | |
|---|---|---|---|
| 2312598 | 12/1976 | France | 114/293 |
| 55-49419 | 4/1980 | Japan | 405/224 |
| 2312598 | 12/1976 | France | 114/293 |

*Primary Examiner*—Sherman D. Basinger
*Attorney, Agent, or Firm*—Bradford E. Kile

[57] ABSTRACT

The invention relates to a method and apparatus for tension mooring an offshore platform having a deck and a plurality of buoyancy columns. An anchor system is initially installed upon the bed of a body of water. Permanent mooring lines are then connected to the anchor system and extend upwardly for support by a buoyancy system located below a lowest portion of the offshore platform and a zone of high oxygen content water adjacent the surface of the body of water. Sacrificial mooring lines are connected to an upper portion of the buoyancy system and extend upwardly through internal conduits with the plurality of bouyancy columns of the floating platform. In the event one of the sacrificial mooring lines becomes damaged the line may be selectively released from the buoyancy system, drawn up through a corresponding interior column and replaced from the deck of the platform.

17 Claims, 9 Drawing Figures

20
22
24
26
32
12
14
18
42
52
54
56
58
64
70
76
78
80
86

METHOD AND APPARATUS FOR TENSION MOORING A FLOATING PLATFORM

RELATED APPLICATION

This application is a continuation-in-part of our prior application Ser. No. 096,075, filed Nov. 20, 1979, now U.S. Pat. No. 4,281,613, entitled "Methods and Apparatus for Mooring a Floating Structure" which is a continuation of our prior U.S. application No. 827,145, filed Aug. 24, 1977 now abandoned.

BACKGROUND OF THE INVENTION

This invention relates to a novel tension mooring system for a floating platform and the like.

Mooring systems for floating structures have been proposed which include a plurality of mooring lines anchored to the bed of a body of water and connected at the upper ends thereof to the floating structure. The mooring lines extend in substantially parallel relationship to each other with the buoyancy of the floating structure being used to maintain the mooring lines under a preselected tension. In this form of mooring system, the floating structure is held substantially level and horizontal movement away from a preselected site introduces forces in the mooring lines which urge the structure toward its equilibrium position.

In the past it has been suggested to utilize templates on the water bed for multiple drilling and for making production connections. Also, it is known to have guidelines extending from such drilling templates and landing bases to the surface of a body of water to allow equipment to be lowered into proper position on the templates. In another previously known system, floats are secured to guide lines at a point below the water surface to allow a vessel to disconnect from the lines and later relocate the lines by sonar for manual recovery.

In addition to the above, others have suggested the use of buoyant members to support mooring lines at intermediate positions below the surface of a body of water. One such prior system comprises a mooring cable which is attached to a buoy and a rope or steel cable is connected from the buoy to the floating structure. In this system, the buoy surrounds and maintains the upper end of the mooring cable at or near the water surface.

It has further been previously suggested that an anchor system for a tension moored drilling and production platform may be set by the platform when it is delivered to the drilling site. This notion is best applied when gravity anchors are to be used instead of piling and is disclosed in a U.S. Ray Pat. No. 3,919,957, of common assignment with the instant application. However, gravity anchors may be large and heavy structures which represent additional complication and expense in the fabrication of a platform in order that it be capable of setting such structures. This complication is worthwhile for a mobile platform which is intended to be moved frequently during its lifetime. In the case of a more permanent installation, however, it may be more economical and timely to utilize anchor piling which can be placed while the drilling or production platform is being constructed. Thus, the anchorage system is ready for connection to the platform when the platform is delivered to the intended site. In this manner valuable time is saved in platform installation and production of a petroleum reservoir can begin more quickly.

Corrosion of mooring lines is a primary consideration in the use of tension moored platforms because the mooring lines are primary structural elements. Failure of the mooring lines may represent a costly delay to the drilling and production activities and may even result in damage to the floating platform. Such a failure may result from loss of strength of the mooring lines as corrosion reduces their available cross sectional area. It is well known that the most corrosive environment for mooring cables is near the sea and air interface, commonly referred to as the splash zone. Here water is highly oxygenated from mixing due to wind and wave action. Furthermore, constant wave action erodes oxides away from metallic surfaces exposing new metal to be attacked by corrosion. Protective coatings can be used on mooring lines within the splash zone as long as said lines require no handling or manipulation. Where handling is required, however, the coating is soon destroyed which renders the remaining coating essentially useless.

The present invention relates to an improved tension mooring system and to an improved method for handling a tension mooring system for a floating structure.

In our prior, above identified, application, an improved tension mooring system was disclosed wherein an anchor system was positioned upon the bed of a body of a body of water and permanent mooring lines were secured to the anchor system to extend upwardly to a submerged buoyancy system. The permanent mooring lines were maintained out of contact with the water zone of high oxygen content which tended to corrode the lines. Sacrificial mooring lines then extended from the buoyancy system upwardly through the high corrosion zone to the floating platform. As the sacrificial lines deteriorated they could be replaced without requiring replacement of the entire mooring system.

In a preferred embodiment, our prior application disclosed the use of sheaves secured to the buoyancy system and flexible wire rope extended downwardly from a first deck mounted reel, around the sheave and upwardly to a second deck mounted reel. When it became necessary or desirable to replace the sacrificial line, new rope was payed out from the first reel and old line was taken up on the second reel until the entire sacrificial line was replaced.

Notwithstanding the advances achieved by our prior tension mooring system, it would be desirable to increase the protection of the sacrificial mooring system. Additionally, it would be desirable to reduce the complexity of the sacrificial line tensioning and replacement structure. Still further it would be desirable to facilitate inspection of the sacrificial mooring lines so that the necessity for replacement could be accurately assessed.

The above areas of concern are not intended to be exhaustive but rather illustrative and should be sufficient to demonstrate that tension mooring systems appearing in the past will admit to worthwhile improvement.

OBJECTS OF THE INVENTION

It is therefore a general object of the invention to provide a novel, tension mooring system which will achieve the advantages of our prior sacrificial mooring system while further achieving desired aspects of the type previously described.

It is a specific object of the invention to provide a novel method and apparatus for tension mooring a floating platform wherein protection of a sacrificial portion of the mooring system may be enhanced.

It is another object of the invention to provide a novel method and apparatus for tension mooring a floating platform wherein the structural complexity of the sacrificial mooring system may be reduced.

It is a further object of the invention to provide a novel method and apparatus for tension mooring a floating platform wherein inspection capability of a sacrificial mooring section may be facilitated.

It is yet a further object of the invention to provide a novel method and apparatus for tension mooring a floating platform wherein protected access may be achieved throughout the mooring system.

It is still a further object of the invention to provide a novel method and apparatus for tension mooring a floating platform wherein line tensioning may be enhanced.

BRIEF SUMMARY OF A PREFERRED EMBODIMENT OF THE INVENTION

A preferred embodiment of the invention which is intended to accomplish at least some of the foregoing objects comprises a tension mooring system having an anchor system positioned upon the bed of a body of water. Permanent mooring lines connect to and extend upwardly from the anchor system and connect to submerged buoyancy members positioned beneath a floating platform. Sacrificial mooring lines are connected between an upper portion of the buoyancy members and the deck of the platform. These conduits advantageously extend through internal conduits fashioned within the buoyancy columns of the floating platform. In the event one or more of the sacrificial mooring lines becomes damaged it may be facilely replaced by disconnecting it from the buoyancy members, withdrawing it up through a corresponding buoyancy column.

THE DRAWINGS

Other objects and advantages of the present invention will become apparent from the following detailed description of a preferred embodiment thereof taken in conjunction with the accompanying drawings, wherein.

DETAILED DESCRIPTION

Figures 1, 2:
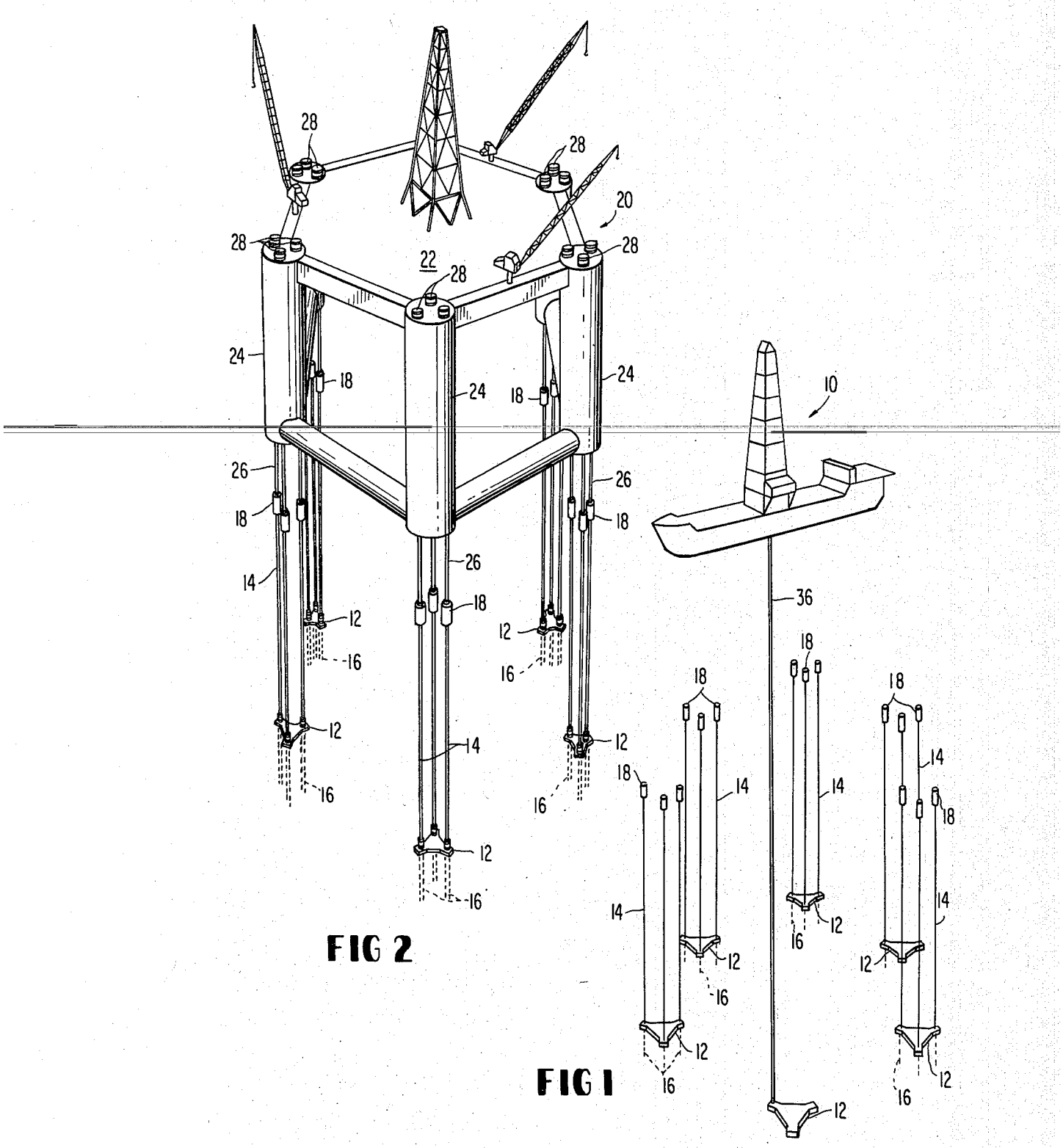
FIG. 1 is an axonometric view disclosing the installation of permanent submerged mooring lines by a work vessel prior to arrival of the permanent floating structure at the mooring site.
FIG. 2 is an axonometric view of an offshore platform moored to the bed of a body of water in accordance with a preferred embodiment of the invention.

Referring now to the drawings wherein like numerals designate like parts and particularly to FIG. 1, a service type of drilling vessel 10 is shown drilling and setting anchor piles through anchor templates 12. Permanent mooring lines 14 are secured to anchor piles 16 and each of the lines 14 is supported at its upper end by a buoy 18.

Once the anchor templates 12 are installed a permanent floating platform 20 is brought onto station. This platform includes an upper deck 22 and a plurality of downwardly extending buoyancy columns 24. Sacrificial mooring lines 26 are connected at the lower ends thereof to an upper portion of the buoys 18 and at the upper ends to deck mounting assemblies 28 which will be discussed more fully below.

The floating platform, per se, does not comprise the subject invention but may comprise one of a plurality of floating platform designs known in the art for oil or gas drilling or production or for other offshore work such as a radar station, light beacon, scientific or exploration laboratory, chemical plant, power generating plant, and the like.

Figure 3:
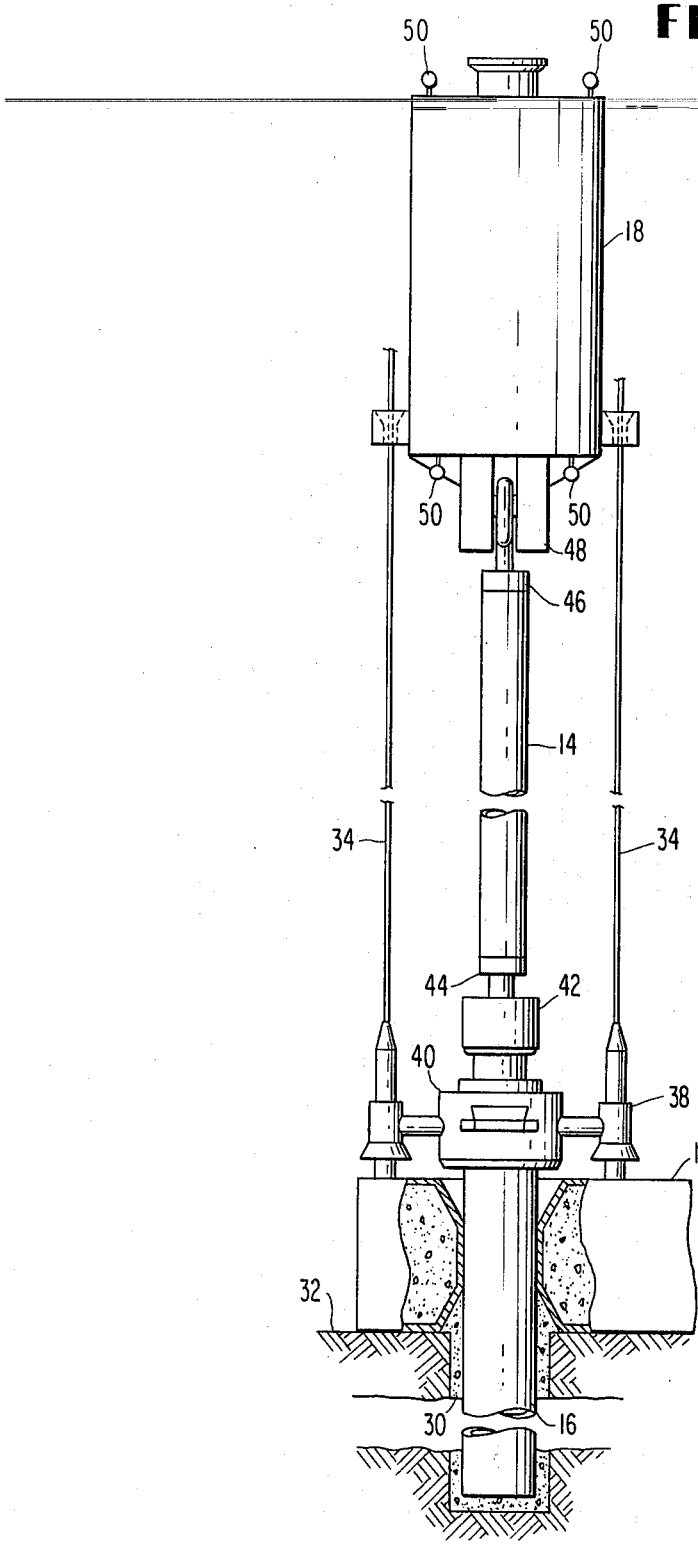
FIG. 3 is a side elevational view, partially broken away, of a permanent mooring line and anchor template secured to the water bed.

Turning to FIG. 3, it will be seen that each anchor includes a pipe or casing 16 which is lowered through the template 12 into a bore hole and the casing 16 is cemented within the bore hole. Alternatively, the anchor piling may be driven through the templates.

The templates 12 are located on the bed 32 of the body of water in a pattern which in a tension mooring installation is the outline of the floating structure to be moored. The templates are lowered onto their location with guidelines 34 which extend to the drilling vessel 10. If a casing 16, separate from a drill string 36 is to be used for the anchor, the guidelines 34 are also used to lower the casing 16 into position. Most often, the guidelines 34 and the drill string 36 are used in setting casing 16 to assure that a landing base 38 is positioned in its proper location. A connector 40 is attached to the lower end of the permanent mooring line 14 and is adapted to be remotely actuated for connection of the permanent mooring lines 14 to the casing or anchor pile 16.

While anchor templates with driven or drilled piling have been specifically illustrated, it is also contemplated that the subject invention may advantageously employ, a gravity base which may provide a reserve oil storage capacity in certain circumstances.

When the mooring line 14 is connected to the anchor pile 16 as shown in FIG. 3, the flexible joint 42 is positioned above the connector 40 to which a lower end 44 of the mooring line 14 is connected. The mooring line 14 may be of any suitable construction such as a cable, pipe or other tension element but is preferred to be a large diameter steel pipe construction with an exterior corrosion resistant coating of a material such as polyurethane to protect the pipe from corrosion. The upper end 46 of mooring line 14 is secured to a mooring buoy 18 as shown in FIG. 3. A connection assembly 48 between the pipe 14 and the buoy may comprise any suitable structure with a pivotal or other flexible connection being preferred. The buoys 18 are positioned sufficiently below the water surface to be out of water turbulence and a high corrosive, high oxygen content zone. Further the buoys are operably positioned directly below the floating platform. With the permanent mooring lines 14 being provided with corrosion protective means and not extending into the more corrosive water near the surface, a need for replacement of the permanent mooring lines 14 is minimized or eliminated.

The buoy 18 is constructed with valving 50 above and below the buoy with all valves being operable by remote control or a diver. The buoy 18 includes a chamber charged with compressed air so that its buoyancy may be adjusted by a diver or remote control.

The buoy 18 is designed to support its own weight, the weight of the permanent mooring line 14, and generates sufficient buoyancy to exert a small additional tension in the mooring lines. In so doing, the buoy 18 removes the requirement that the floating platform 20 provide the buoyancy necessary to offset the weight of the permanent mooring apparatus. By removing this requirement the floating platform may be designed with reduced displacement or, alternatively, with higher payload capacity for the same displacement. The buoy system is preferably composed of individual buoys 18. Alternatively, one large buoy or clusters of three or more buoys may be combined as desired.

Figure 4:
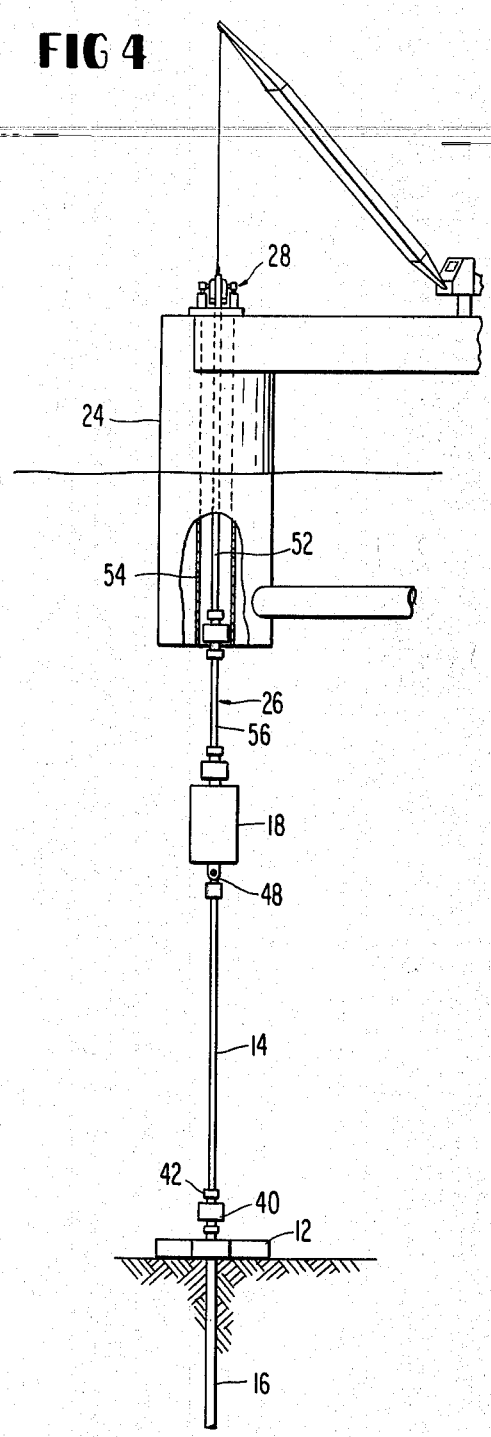
FIG. 4 is a side elevational view of the subject mooring system including a permanent mooring line, an intermediate buoyant member, and a sacrificial mooring line connected to an upper portion of the buoyant member and extending through an internal conduit longitudinally fashioned through a downwardly extending buoyancy column of the offshore platform.

Turning now to FIG. 4, there will be seen a sacrificial mooring system in accordance with a preferred embodiment of the subject invention. More specifically, the sacrificial mooring line 26 includes a first tubular section 52 which extends within an interior column 54 of the buoyancy column 24 and a second tubular section 56 which extends below the buoyancy column.

Figure 5:
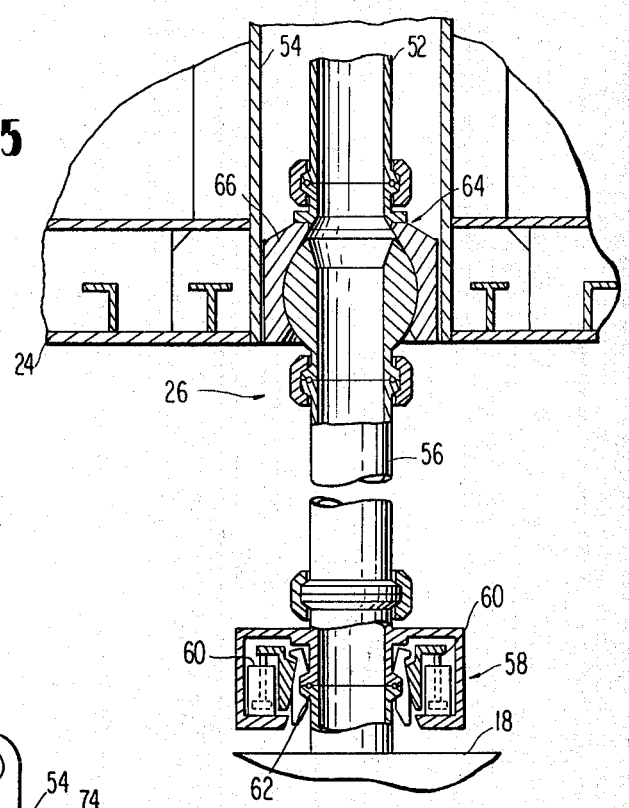
FIG. 5 is a detailed cross-sectional view disclosing a remotely releasable coupling between the buoyant member and a sacrificial mooring column and a pivotal junction of the sacrificial mooring column at the base of the platform buoyancy column.

As detailed in FIG. 5, the lower portion of the second tubular section 56 is releasably connected to the upper portion of buoy 18 by a remotely actuatable hydraulic clamp 58. The detailed structure and operation of such clamps is well known in the art and thus will not be described in detail except to note that hydraulically actuation of piston and cylinder assemblies 60 operably serve to release clamp arms 62 when it is desired to disconnect the second tubular section 56 from the buoy 18.

The lower end of the first tubular section 52 is connected to the upper end of the second tubular section via a flexible connection assembly such as a ball joint 64. Such ball joint assemblies are also well known in the art and are specifically designed to carry a high degree of axial tension loads. A cylindrical collar 66 surrounds and forms a part of the ball joint structure. This collar further serves to slidingly guide sacrificial mooring line 26 within the interior column 54 of the floating platform.

Figure 6:
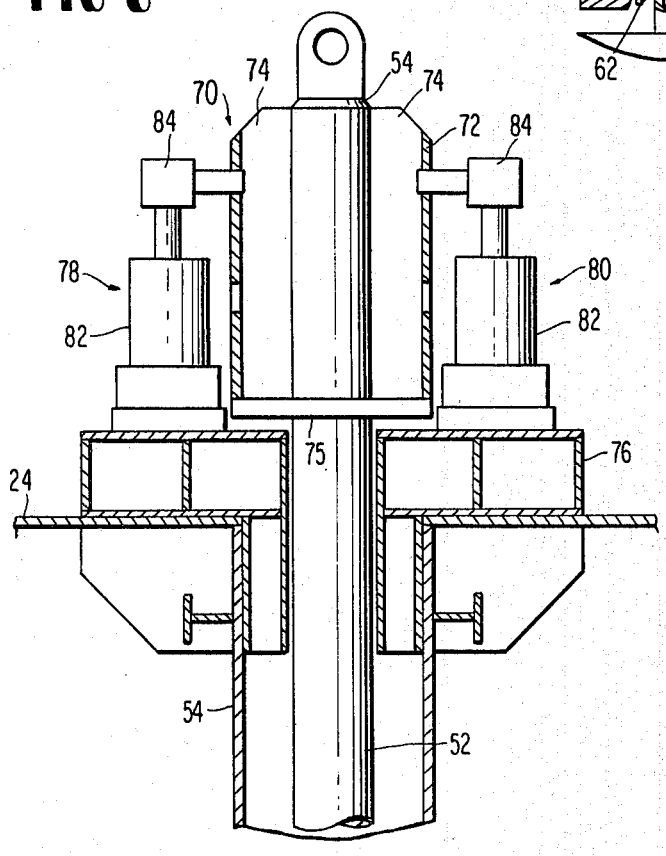
FIG. 6 is a detailed cross-sectional view of a sacrificial mooring column tension mechanism mounted upon the deck of the floating platform.

As disclosed in FIG. 6, an upper end of the first tubular section 52 is fitted with an enlarged bearing head 70 comprising a cylindrical outer member 72 and a plurality of radial shear plates 74 which connect the cylindrical member 72 with the tubular section 52. A cylindrical stepped bushing 76 extends about the upper end of the internal conduit 54 and buoyancy column 24.

In operation a base plate 75 of the enlarged bearing head 70 abuts against the bushing 76. Accordingly, as buoyancy is controlled within the buoyancy column 24 tension will be applied to the sacrificial mooring line 24, buoy 18 and permanent mooring line 14 down to the anchor. As previously noted, this axial tension serves to keep the floating platform 20 on station.

FIG. 6 also depicts a pair of hydraulic tension assemblies 78 and 80. Each assembly comprises a power piston and cylinder assembly 82 and a horizontally actuatable engagement assembly 84. Assemblies 84 are hydraulically operable to selectively engage aperatures within the cylinder 72 and apply added axial tension to selected tension mooring lines when a sacrificial mooring section is being replaced.

Figures 7, 8, 9:
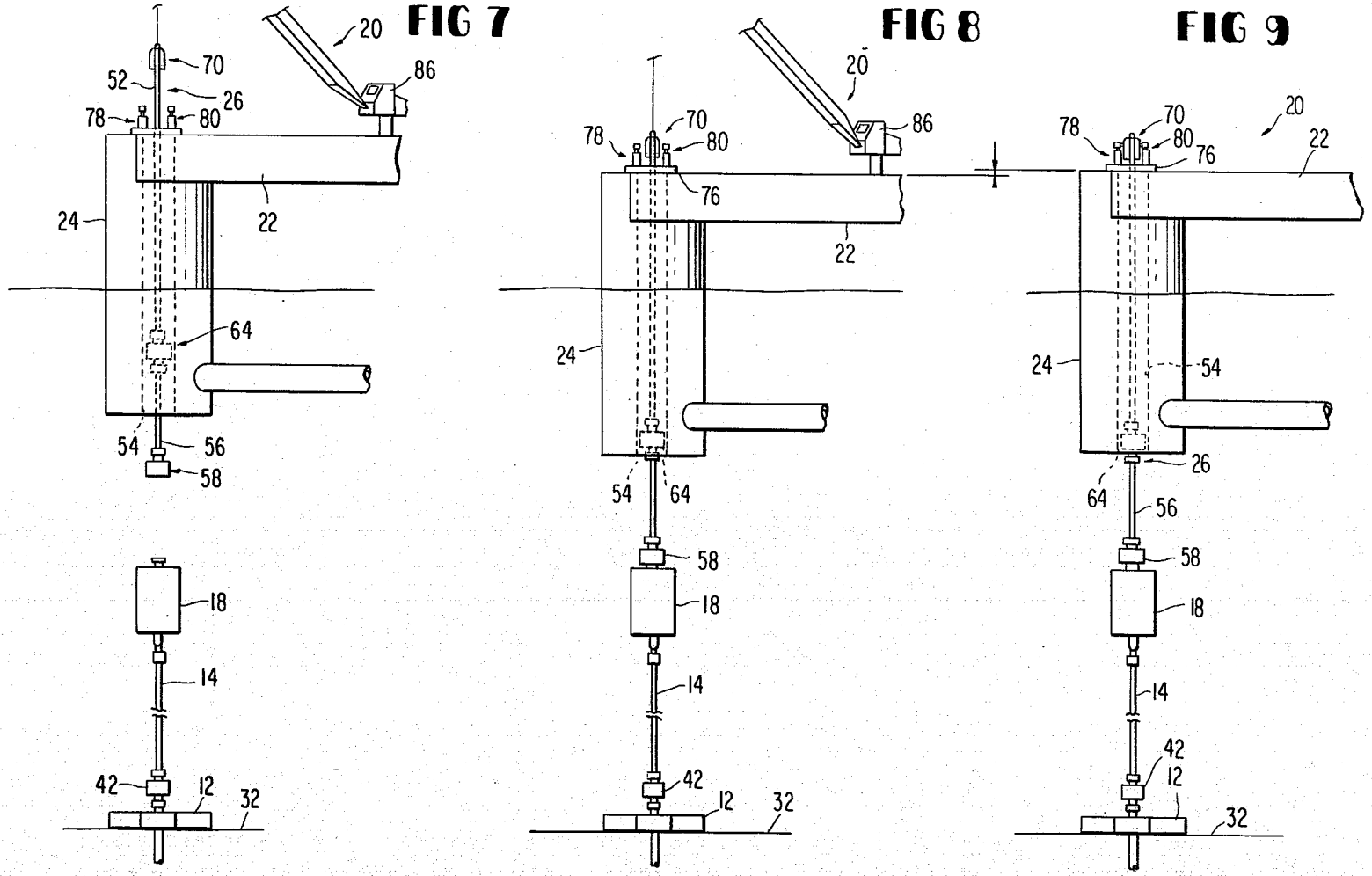
FIGS. 7–9 discloses a sequence of installing a sacrificial mooring column in accordance with a preferred embodiment of the invention.

With reference to FIGS. 7–9, there will be seen a sequence of views depicting installation and/or replacement of a damaged sacrificial mooring line 26. More specifically, in FIG. 7, the floating platform 20 is shown positioned over a previously installed permanent mooring line 14, note also FIGS. 1 and 2. In this position a sacrificial mooring line 26 is lowered via a utility crane 86 longitudinally through an internal conduit 54 within a downwardly extending buoyancy column 24 of the platform. As previously noted, the sacrificial mooring line 26 is composed of an upper tubular section 52 and a lower tubular section 56 which are interconnected via a flexible coupling 64.

The sacrificial mooring line 26 is lowered within the internal column 54 until the connector 58 engages the upper portion of the buoyancy member 18. Upon attachment of all of the connectors 58 with corresponding buoyancy chambers 18 ballast is blown from the buoyancy columns 24 and the floating platform is elevated such that the bushings 76 abut against the bearing plates 75 of the enlarged bearing heads 70. Further ballast is then blown from the floatation columns and the entire mooring system is placed under tension to hold the platform on station.

The first tubular members 52 of the sacrificial mooring strings 26 are axially dimensioned such that upon tensioning of the mooring system, the flexible connectors 64 extend to the bottom of the interior conduits 54. As previously noted, a degree of motion is accomodated between the first and second sections of the sacrificial mooring section through the flexible connectors 64 to relieve bending stresses.

Each of the buoyancy columns 24 is preferably fitted with a plurality of sacrificial mooring lines and in the most preferred embodiment three lines are simultaneously utilized. When it is desired to replace an individual sacrificial mooring line 26 the tension at any given column 24 can be maintained by increasing the tension in the stable lines while the damaged line is being replaced. In this connection, the hydraulic assemblies 78 and 80 are engaged with the head portions 70 of the sound lines and are jacked up to add tension to these lines; note FIGS. 6 and 9 where the base plate 75 is elevated above the bushing 76.

Once tension is relieved from the damaged line by application of jack assemblies 78 and 80, the connector 58 is released from the buoy 18 and the sacrificial mooring line 26 is withdrawn and inspected and/or replaced as desired. Upon replacement, the jack-up assemblies are released and the tension load is redistributed among the sacrificial mooring lines 26. In a preferred form, the jack-up tension on the stable lines is controlled to be equal, in combination, to the tension normally carried by the damaged line.

SUMMARY OF MAJOR ADVANTAGES OF THE INVENTION

After reading and understanding the foregoing description of the invention, in conjunction with the drawings, it will be appreciated that several distinct advantages of the subject floating platform mooring system are obtained.

Without attempting to set forth all of the desirable features of the instant invention at least some of the major advantages include the provision of a sacrificial mooring assembly which extends longitudinally through buoyancy columns of the platform. This protects and shields the high tension members in the highest oxygen content zone of the sea. In addition, this placement shields the high tension lines from contact with objects floating on the sea.

Use of the tubular tension members for the sacrificial mooring lines permits high tension to be carried by each unit and further, in combination with flexible connectors having a central internal passage, permits inspection equipment to be periodically lowered into the mooring lines to provide accurate detection of areas of deterioration. In a similar vein, when a gravity base is utilized along with tubular permanent mooring lines, fluids may be run down to the base from the platform deck as desired.

Additionally it will be appreciated that the tensioning and replacement equipment for the subject system is significantly simplified with respect to previously known systems.

Still further the flexible connectors enable a degree of stress relieving flexture to accommodate bending loads which otherwise might be imparted to the mooring system.

Yet further the subject method and apparatus provides a system to facilely replace damaged sacrificial lines while maintaining the stability of the overall mooring system.

In describing the invention, reference has been made to a preferred embodiment and illustrative advantages of the invention. Those skilled in the art, however, and familiar with the instant disclosure of the subject invention, may recognize additions, deletions, modifications, substitutions and/or other changes which will fall within the purview of the subject invention and claims.

What is claimed:

1. A tension mooring system for a floating platform having an upper deck and a plurality of buoyancy columns extending downwardly from the deck, said mooring system comprising:

anchor means positioned upon the bed of a body of water;

permanent mooring lines secured to said anchor means and extending upwardly;

buoyancy means connected to the upper ends of said permanent mooring lines at a location below a zone of high corrosive, high oxygen content water adjacent to the surface of the body of water, said connecting location further being below the lowest portion of the floating platform, and said permanent mooring lines being dimensioned to maintain said buoyant means in a submerged posture below the lowest portion of the platform;

sacrifical mooring means connected to a submerged upper portion of said buoyancy means and extending upwardly therefrom and being connected to the platform, said sacrificial mooring means comprising, a plurality of sacrificial mooring lines, each of said sacrificial mooring lines extending upwardly from said buoyancy means and longitudinally and slidably extending through a corresponding interior column in a downwardly extending buoyancy column of the platform;

first means connected to one end of each of said sacrificial mooring lines for releasably connecting said one end of each of said sacrificial mooring lines to said buoyancy means; and second means connected to the other end of each of said sacrificial mooring lines for releasably connecting the other end of each of said sacrificial mooring lines to the deck of the platform, such that, upon damage to a sacrificial mooring line, the line may be selectively released from the buoyancy means, drawn up through an interior column in a corresponding leg of the platform and replaced.

2. A tension mooring system for a floating platform as defined in claim 1 wherein each of said sacrificial mooring lines comprises:

a tubular member.

3. A tension mooring system for a floating platform as defined in claim 2 wherein each of said tubular sacrificial mooring lines comprises:

a first tubular section extending within the interior column of a buoyancy column for connection at one end to the platform;

a second tubular section extending below the buoyancy column for connection at one end to said buoyant means; and flexible connection means for mutually interconnecting the other ends of said first and second tubular sections within the interior column at a location generally at the interface of the bottom end of the buoyancy column and the body of water.

4. A tension mooring system for a floating platform as defined in claim 3 wherein said tension mooring system further comprising:

collar means connected about said flexible connection means and being exteriorly dimensioned to snuggly slide within the interior column of the platform buoyancy column.

5. A tension mooring system for a floating platform as defined in claim 3 wherein said flexible connection means comprises:

a ball joint wherein said ball is provided with a central longitudinal passage such that open internal communication exists between said first and second tubular sections to permit internal inspection of the entire sacrificial mooring line.

6. A tension mooring system for a floating platform as defined in claim 3 wherein each of said permanent mooring lines comprises:

a tubular member.

7. A tension mooring system for a floating platform as defined in claim 6 wherein said buoyant means comprises:

individual buoyancy chambers connected to the upper end of each of said permanent tubular members and to the bottom of each of said sacrificial tubular members.

8. A tension mooring system for a floating platform as defined in claim 1 wherein said sacrificial mooring means comprises:

at least two sacrificial mooring lines extending through each of the downwardly extending buoyancy columns.

9. A tension mooring system for a floating platform as defined in claim 8 wherein said second means connected to the other end of each of said sacrificial mooring lines includes:

means for selectively tensioning each sacrificial mooring line wherein extra tension may be applied to at least one sacrificial mooring line while another sacrificial mooring line is being replaced.

10. A tension mooring system for a floating platform as defined in claim 1 wherein:

said anchor means comprises a plurality of individual templates secured to the bed of the body of water;

said mooring lines extend upwardly in generally mutual parallel relationship; and said buoyancy means comprises a plurality of individual buoys, one being connected to the other end of each of said mooring lines.

11. A mooring system for a floating platform having an upper deck and a plurality of buoyancy columns extending downwardly from the deck, said mooring system comprising:

anchor means positioned upon the bed of a body of water;

a plurality of permanent mooring lines secured to said anchor means and extending upwardly;

buoyancy means connected to the upper ends of said permanent mooring lines at a location below the bottom of the downwardly extending buoyancy columns;

at least two internal columns extending longitudinally within each buoyancy column of said plurality of buoyancy columns of said floating platform;

tubular sacrificial mooring lines connected at one end to said buoyancy means, extending upwardly from said buoyancy means, slidably extending longitudinally through the internal columns of said downwardly extending buoyancy columns and connecting to the deck of the floating platform; and at least two tubular sacrificial mooring lines extend through said corresponding at least two longitudinally extending internal conduits within each buoyancy column whereby at least one of the sacrificial mooring lines may be maintained operative within each buoyancy column in the event one of the sacrificial mooring lines is being replaced.

12. A mooring system for a floating platform as defined in claim 11 wherein each tubular sacrificial mooring line comprises:

a first tubular section extending within a corresponding internal conduit within a respective downwardly extending buoyancy column;

a second tubular section extending below the buoyancy column for connection to said buoyancy means; and flexible connection means for mutually interconnecting said first and second tubular sections at a location within the internal conduit at approximately the bottom of a respective buoyancy column.

13. A mooring system for a floating platform as defined in claim 12 and further comprising:

means connected to each of said first tubular sections for selectively tensioning a corresponding sacrificial mooring line.

14. A mooring system for a floating platform as defined in claim 13 wherein said flexible connection means comprises:

a ball joint having an outer collar means connected about said ball joint and being dimensioned to snuggly slide within the interior of a corresponding internal conduit within the platform buoyancy column.

15. A mooring system for a floating platform as defined in claim 14 wherein:

said ball joint is provided with a central longitudinal passage such that open internal communication exists between said first and second tubular sections to permit internal inspection of the sacrificial mooring lines.

16. A method for tension mooring a floating platform having an upper deck and a plurality of buoyancy columns downwardly extending from the deck, said method comprising the steps of:

installing anchor means upon the bed of a body of water;

installing a plurality of permanent mooring lines at the anchor means and extending upwardly to and being supported by buoyancy means at a location generally below the bottom of the downwardly extending buoyancy columns;

extending at least two tubular sacrificial mooring lines through internal conduits within each of said buoyancy columns and connecting one end of the sacrificial mooring lines to the buoyancy means and the other end of the sacrificial mooring lines to the deck of the floating platform;

tensioning the sacrificial mooring lines through the buoyancy means, permanent mooring lines and anchor means ~~to maintain the floating platform on~~ station; and in the event of damage to a sacrificial mooring line, increasing the tension in at least one other sacrificial mooring line extending through the buoyancy column having the damaged line, releasing the damaged sacrificial mooring line from the buoyancy means, removing and replacing the damaged sacrificial mooring line from the deck of the floating platform, connecting said replacement sacrificial mooring line to the buoyancy means, and decreasing the tension in the at least one other sacrificial mooring line and thereby tensioning said replacement sacrificial mooring line.

17. A method for tension mooring a floating platform as defined in claim 16 wherein:

said step of increasing the tension in at least one other sacrificial mooring line is performed until tension is applied in said at least one other line in an amount to substantially offset the tension normally carried by said damaged line.

* * * * *